United States Patent [19]

Pettifer

[11] Patent Number: 5,070,559

[45] Date of Patent: Dec. 10, 1991

[54] ADJUSTABLE SPINAL SUPPORT

[75] Inventor: Richard T. Pettifer, North Vancouver, Canada

[73] Assignees: New Era Marketing, Ltd., Richmond, Canada; James F. Crane, Richmond, Canada; John E. Crane, Richmond, B.C., Canada; Michael D. Parfitt, Sidney, Canada; 4 West Agencies, Ltd., Vancouver, Canada

[21] Appl. No.: 638,973

[22] Filed: Jan. 8, 1991

[51] Int. Cl.[5] ..... A47C 27/10

[52] U.S. Cl. ..... 5/455; 5/457; 5/464

[58] Field of Search ..... 5/446, 455–457, 5/464, 463, 449, 447, 453; 297/284 E, DIG. 3

[56] References Cited

U.S. PATENT DOCUMENTS

| | | | |
|---|---|---|---|
| 1,146,615 | 7/1915 | Dodd | 5/457 |
| 2,415,150 | 2/1947 | Stein | 5/464 X |
| 3,303,518 | 2/1967 | Ingram | 5/464 X |
| 3,428,974 | 2/1919 | Stuart | 5/464 X |
| 3,982,786 | 9/1976 | Burgin et al. | 5/457 X |
| 4,662,012 | 5/1987 | Torbet | 5/453 |
| 4,788,730 | 12/1988 | Bexton | 5/455 X |
| 4,852,195 | 8/1989 | Schulman | 5/453 |

*Primary Examiner*—Michael F. Trettel

*Attorney, Agent, or Firm*—Chernoff, Vilhauer, McClung & Stenzel

[57] ABSTRACT

A novel portable spinal support which is useful for supporting the lumbar region of a person's spine and reinforcing areas of a mattress to provide spinal support. A multiple chambered pneumatically inflatable spinal support comprising: (a) a first type discrete pneumatically inflatable chamber located in the interior of the support; (b) at least two second type discrete pneumatically inflatable chambers located on one side and adjacent to the first chamber; (c) at leat two third type discrete pneumatically inflatable chambers located adjacent to the first chamber on the side opposite to the second chambers; (d) at least two fourth type discrete pnematically inflatable chambers, one located adjacent to the first chamber at one end of the support and the other located adjacent to the first chamber at the opposite end of the support; and (e) separate inflation valve means for each chamber, said inflation valve means being operable for inflation and closable after the respective chamber has been inflated pneumatically.

15 Claims, 8 Drawing Sheets

ADJUSTABLE SPINAL SUPPORT

FIELD OF THE INVENTION

This invention is directed to a novel method and a portable, adjustable, spinal support which is useful for providing support to a person's spine while the person is in a reclining position. In one application, the spinal support is useful for reinforcing areas of a sleep surface so as to provide levelling support to the spine of a person while sleeping on the sleep surface.

BACKGROUND OF THE INVENTION

Gravity is a major enemy of a healthy, pain free spine. The human embryo develops in the womb suspended in amniotic fluid which minimizes the effects of gravity. Otherwise, deformation in the development of the skeletal structure of the fetus from the force of gravity would result.

During infancy, and in the formative growth years of development, gravity has minimum impact. A child is not heavy, has resilient bones, and is able to sleep in any position and virtually anywhere, including on hard floors. This can be done without any undue adverse gravitational effects on the child's skeletal structure, or suffering ill effects such as nerve pain from spinal distortion, or circulatory reduction caused by pressure points on the shoulders, hips and buttocks, caused by the hard sleep surface.

The bodies of young adults are still relatively resilient and can withstand the gravitational forces without undue discomfort or harm. For example, young fit adults are able to sleep directly on the ground while camping.

As a person becomes older, the body, and especially its skeletal structure, becomes less resilient and hence more vulnerable to the adverse forces of gravity. Depending on physical condition, a person's body increases in weight and the skeleton, including the spine, becomes less flexible. The spine, with its complex disc, vertebrae and nerve structure, is a delicate mechanism and prone to breakdown. When the spine is distorted from its normal linear form for long periods of time, such as while reclining on a poor sleeping surface, gravitational force is exerted on the shoulders, waist and hips of the person, thereby compressing the spine and causing and the spinal nerves to be pinched by the vertebrae, thus generating pain, and potential nerve damage, if the poor sleep surface problem is not rectified. The pressure points at the shoulders and hips also become numb due to lack of oxygen caused by reduced blood circulation in these areas. These spinal pain and circulation problems have been recognized for many years by physicians as a problem with bed-ridden patients in hospitals. Also, millions of adults regularly visit their physicians complaining of morning back pain.

It is a medically accepted fact that the human spine during sleep should be supported so that it retains generally the same sinuous linear form or shape as when the body is in a vertical, standing, or sitting position. This minimizes pressure on the many nerves, such as the sciatic nerves, emanating from the spinal column. During the sleep period, the spine should be placed in a neutral position and should not incur the same gravitational compression that occurs when the spine is in the vertical position. The spine should be placed in a neutral or tension condition during the sleep period so as to rejuvenate the spine and the supporting muscles for the next day's activities. This allows for a relaxed, rejuvenating sleep.

The human form is individually unique in shape and weight displacement throughout its length. Yet existing sleep surfaces used by humans usually have the same degree of compression throughout the entire sleep surface. This would be acceptable if the human form was in the shape of a cylinder requiring even support throughout its length, while in a prone position. To provide proportional support for specific uneven weight distributions throughout the length of a human's reclining body, the sleep surface should ideally provide increased compression support for the heavier areas of the body and lower compression support for other area of the body.

This problem is partially recognized by the layman, in dealing with the head while sleeping. The head is one of the heaviest, concentrated areas of a person's body. Also, the neck is a vulnerable area. A sleeping adult usually obtains support and comfort in the cervical (neck) area of the spine by selecting a correct pillow, or pillows, to prop up the head and neck. This is a partial solution to the uneven weight distribution throughout a person's body. However, solutions to the uneven weight distribution of other areas of the body have not been addressed. This invention provides specific custom manual adjustment support for the lumbar area of the spine and accommodates all normal sleeping positions.

For thousands of years, mankind, while sleeping or resting, has reclined on a wide variety of sleep surfaces and supports. In western civilizations, the most commonly used sleep surface upon which a person sleeps is a mattress, or a mattress and an underlying boxspring. A wide variety of mattress types have been developed over the years, including coil spring mattresses of various grades of firmness, mattresses stuffed with various resilient materials, plastic foam mattresses and air and water inflated mattresses. With the advancement of medicine, and a better understanding of a person's spinal column, it has become established that the type and quality of a mattress upon which a person reclines, particularly if the person has a spinal weakness or handicap, or some other handicap such as shoulder bursitis or hip arthritis, is extremely important to maintaining health of the spine. It is widely accepted by physicians and chiropractors that a firm mattress is more beneficial than a soft mattress for such persons. A firm mattress prevents the user's spine from sagging unduly, a condition which tends to aggravate spinal problems. Nevertheless, even expensive firm mattresses do not provide ideal support for a person with a back problem, or a person with some other handicap, especially after prolonged use. A firm mattress tends to raise and place pressure points on the hips and shoulders of the person lying on the mattress. The waist (lumbar) area of the spine, which is one of the parts most vulnerable to nerve pinching problems, remains largely unsupported.

Mattresses that are used in institutions such as hospitals, golden age homes, and the like, do not have the capability of being selectively supportive of specific areas of the recliner's body. As a general rule, the mattresses used by these institutions, and also those used by the inhabitants of residences, are of the same firmness throughout, and do not provide selective degrees of firmness for specific areas of the mattress. Infirmed or elderly persons often require different levels of firmness or elevation for specific areas of the mattress. Pillows and cushions are used to prop up various areas.

The following patents disclose inventions that are more or less pertinent to the subject invention.

| U.S. Pat. No. | Inventor | Issue Date |
|---|---|---|
| 4,697,290 | Alklind | Oct. 6, 1987 |
| 4,617,690 | Grebe | Aug. 24, 1986 |
| 4,467,484 | Magatake et al. | Aug. 29, 1984 |
| 4,357,724 | Laforest | Nov. 9, 1982 |
| 4,206,322 | Young et al. | Dec. 22, 1981 |
| 3,242,511 | Fultz et al. | Mar. 29, 1966 |
| 2,822,544 | Wenzelberger | Feb. 11, 1958 |
| 2,000,873 | Arens | May 7, 1935 |

Alklind discloses a device for insertion under a mattress. The device includes a board with inflatable cells. The cells on each side of a longitudinal centre-line are independently inflatable to provide a rocking motion. No disclosure is made of specifically inflating specified areas to provide support for specific areas of a person's spine or specific weakened areas of a mattress.

Grebe discloses an inflatable bed patient mattress. Grebe does not disclose a device which underlies or cooperates with a mattress. The air mattress disclosed by Grebe is inflatable as a single unit around its periphery.

Takeuchi discloses a multi-chambered air bladder which has selectably inflatable chambers. The chambers underlay a fabric covered foam layer. The whole unit is used as a wrist or ankle wrap, and is not for spinal support or for use as a mattress support The Laforest, Arens and Fultz et al. patents all disclose inflatable bladders having a central cavity therein for insertion in conventional mattresses. None of the foregoing patents discloses an inflatable bladder with separate inflation chambers for individual inflation. None of the listed patents discloses a custom device for use under a mattress to support the spine of a sleeper or uplift depressed areas of the mattress.

Wenzelberger discloses a pillow or cushion which is formed of foamed resilient material. The material is cast around an inflatable air tube/bladder.

Magatake et al. disclose a pneumatic cushion made from a thin elastic sheet which can be repeatedly inflated. It includes a board to isolate the welded portion from tension forces.

SUMMARY OF THE INVENTION

This invention pertains to a novel custom inflatable adjustable spinal support. More particularly, this invention relates to a spinal support in the form of a custom designed compartmentalized bladder, the compartments of which can be selectively inflated to provide locally enhanced spinal support, comfort and relief of back pain in commensurate areas of the human spinal column. This spinal support is used when the adult is in a prone sleeping position. The support can be used underneath any existing sleep surface.

The invention pertains to a method of providing specific support to specific trunk and torso regions of a person's spine while the person is reclining, comprising placing under the trunk and torso of the person: (a) a first type discrete pneumatically inflatable chamber; (b) at least two second type discrete pneumatically inflatable chambers located on one side and adjacent to the first type chamber; (c) at least two third type discrete pneumatically inflatable chambers located adjacent to the first type chamber on the side opposite to the second type chambers; (d) at least two fourth type discrete pneumatically inflatable chambers, one located adjacent to and at one end of the first chamber and the other located adjacent to the first chamber at the opposite end; and (e) inflating the first chamber type (a) to about 30 to 40 percent, inflating the second chamber type (b) about 20 to 30 percent, inflating the third chamber type (c) about 20 to 30 percent, and inflating the fourth chamber type (d) about 5 to 10 percent.

The specific support can be provided under the mid-region of a mattress, upon which the person is reclining. The two second type chambers (b) can be inflated at the same time from a common air pressure source. The two third type chambers (c) can be inflated at the same time from a second common air pressure source. The chambers can be inflated through conduits which are located in seams between each chamber.

The invention consists of a portable multiple chambered pneumatically inflatable spinal support comprising: (a) a first type discrete pneumatically inflatable chamber located in the interior of the support; (b) at least two second type discrete pneumatically inflatable chambers located on one side and adjacent to the first chamber; (c) at least two third type discrete pneumatically inflatable chambers located adjacent to the first chamber on the side opposite to the second chambers; d) at least two fourth type discrete pneumatically inflatable chambers, one located adjacent to the first chamber at one end of the support and the other located ad]acent to the first chamber at the opposite end of the support; and (e) inflation valve means for each chamber, said inflation valve means being operable for inflation and closable after the respective chamber has been inflated pneumatically.

In the support, separate elongated tubes can be connected to each of the valve means connected to each individual chamber, each individual chamber being inflatable by means of the tube that is specifically connected to the specific chamber and its valve means. The tubes connected to second type chambers (b) can be connected together so that chambers (b) are inflated commonly at the same time to the same pressure. The tubes connected to the third type chambers (c) can be connected together so that chambers (c) are inflated commonly at the same time to the same pressure.

The first type chamber (a) can be of a diamond shape, and the second and third type chambers (b) and (c) can be of a diamond shape and comprise at least six in number, three of which are disposed adjacent one another on one side of the first type chamber (a), and the other three are disposed adjacent one another on the opposite side of the first type chamber (a).

The support can include at least two fifth type discrete pneumatically inflatable chambers, each located to the exterior of the first four types of chambers (a), (b), (c) and (d). The fifth type chamber (e) can be of a triangular shape, one being wedged between the second type chamber (b), and the other being wedged between the third type chamber (c). One or more of the chambers can be connected together and can be inflated as a unit.

The valve means and tubes can be located in recesses which exist between each adjacent chamber. The valve means can be embedded in areas between adjacent chambers and inflation conduits to each chamber are located in the areas between adjacent chambers.

DRAWINGS

In the drawings which disclose specific embodiments of the invention and are not intended to restrict the spirit or scope of the invention in any way:

FIG. 1 illustrates a plan view of the inflatable spinal support;

FIG. 2, which appears on the same sheet as FIG. 5, illustrates a bottom view of the portable spinal support positioned under a sleep surface;

FIG. 3*a* illustrates a view of the spinal support taken through section line X—X of FIG. 1;

FIG. 3*b* illustrates a view of the spinal support taken through section line Y—Y of FIG. 1;

Figure 6B:
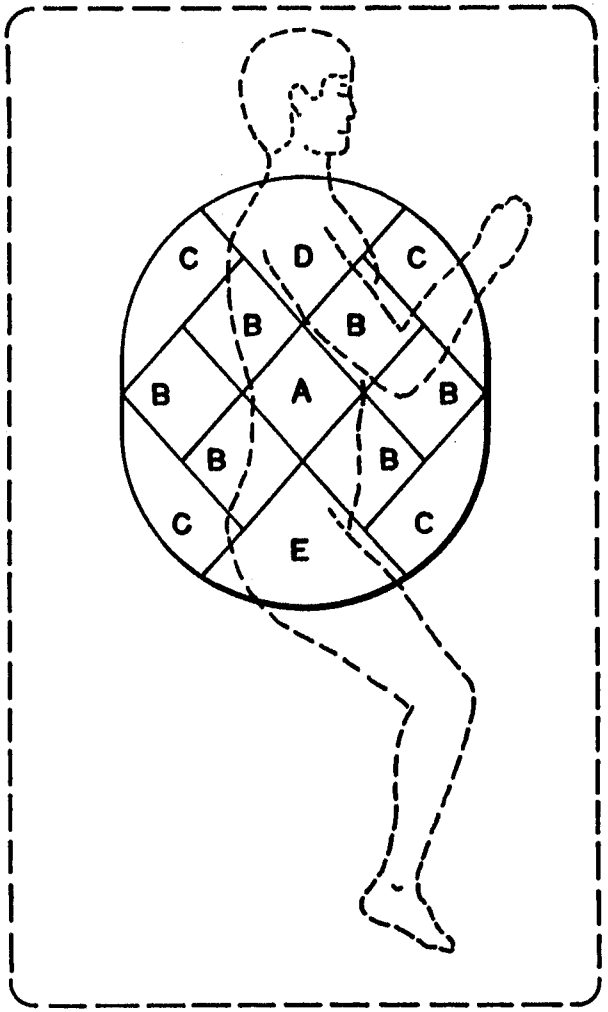
Figure 6A:
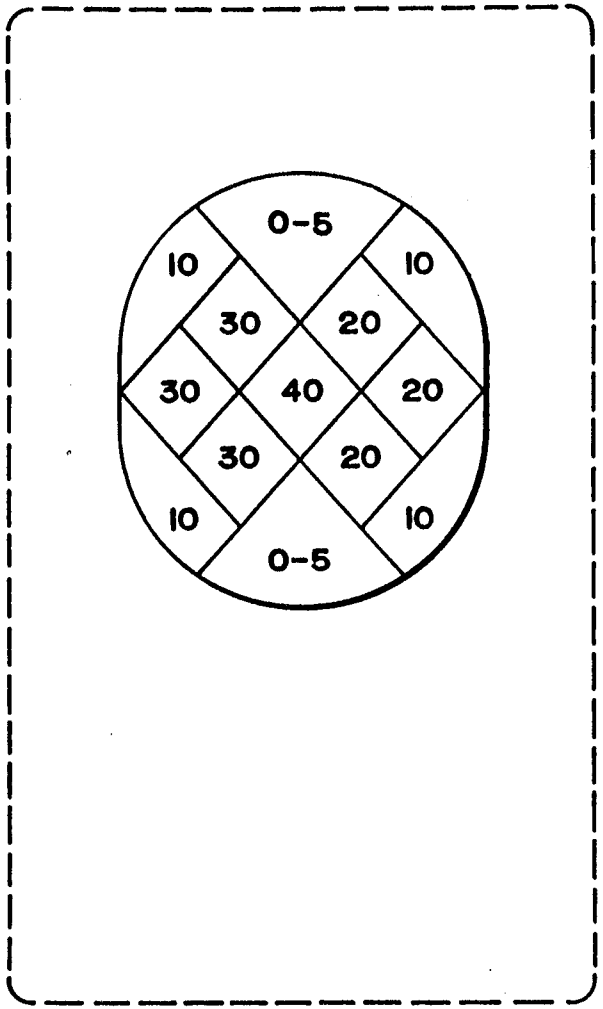
Figure 7B:
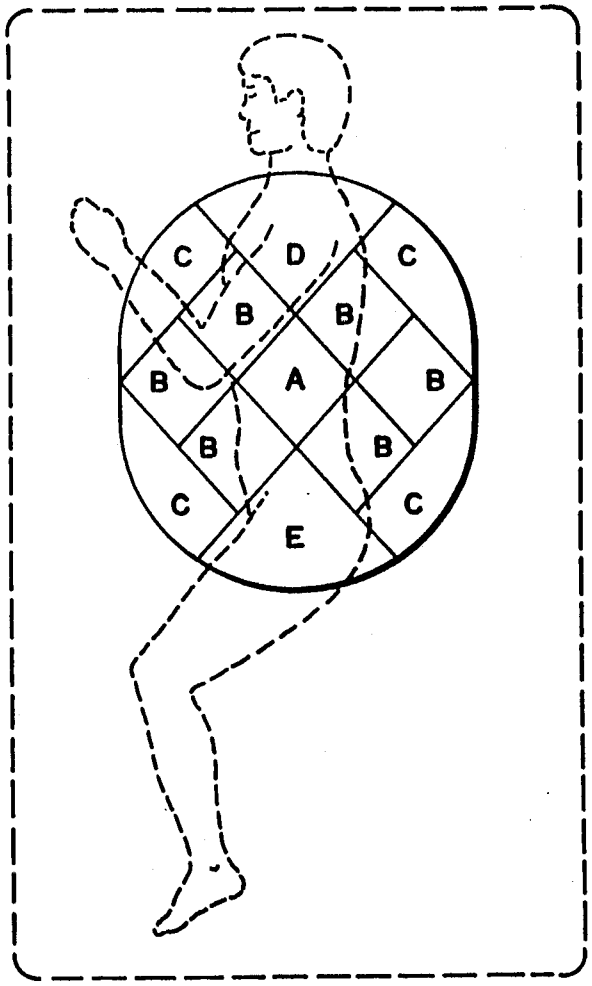
Figure 7A:
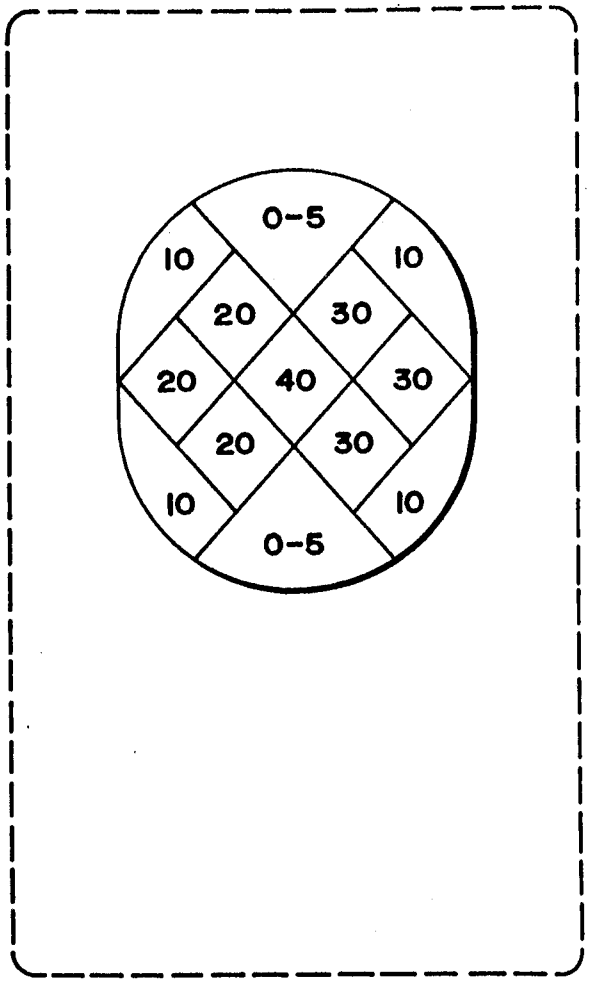
Figure 8B:
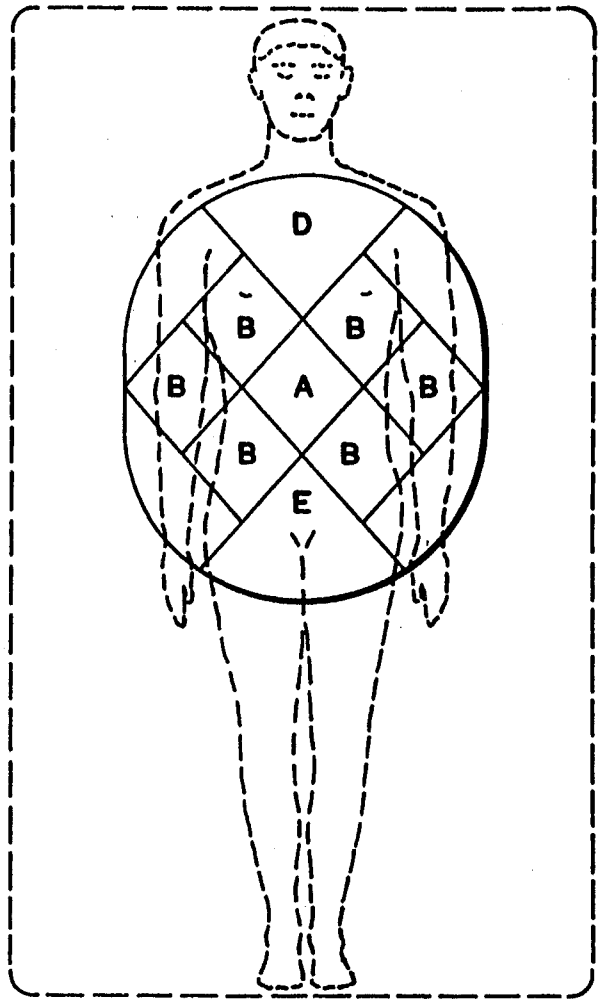
Figure 8A:
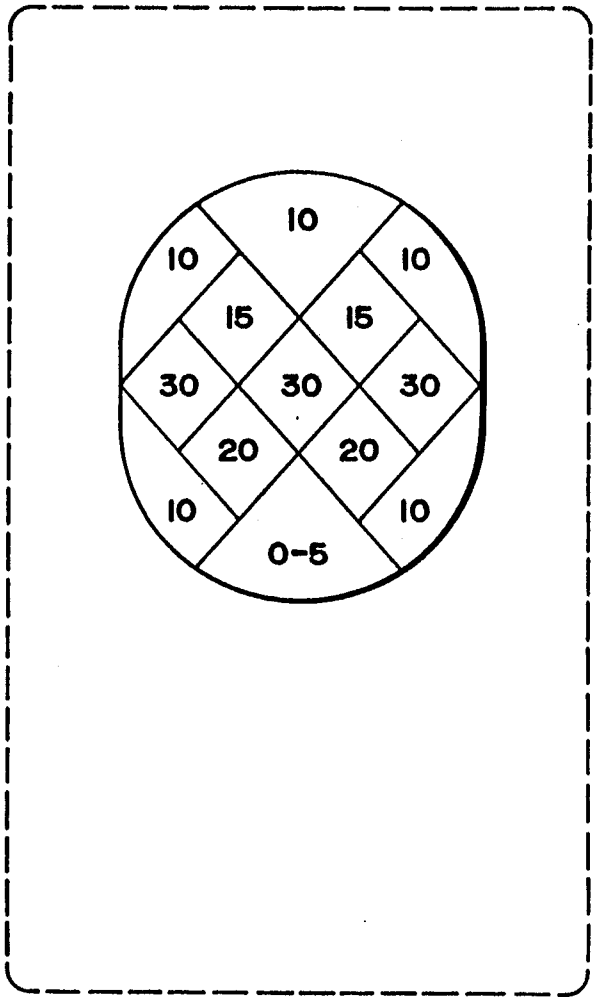
Figure 9B:
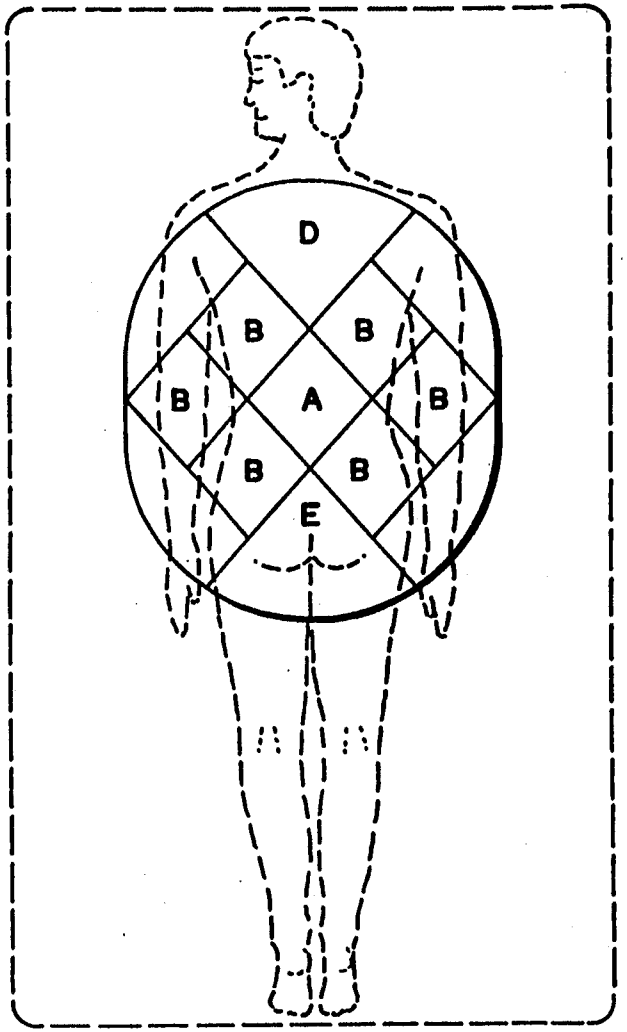
Figure 9A:
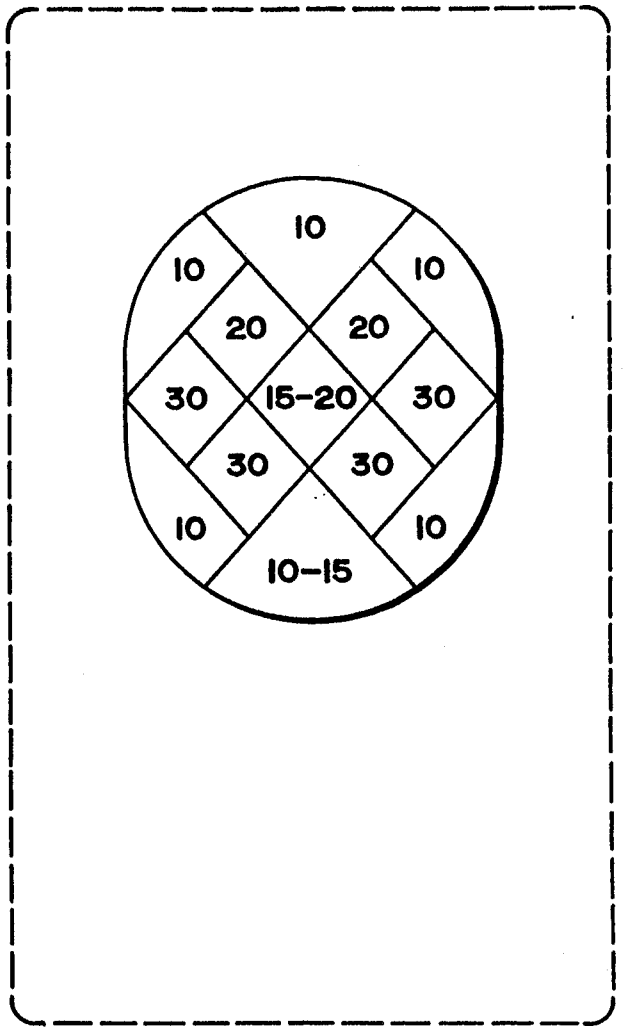
Figure 10:
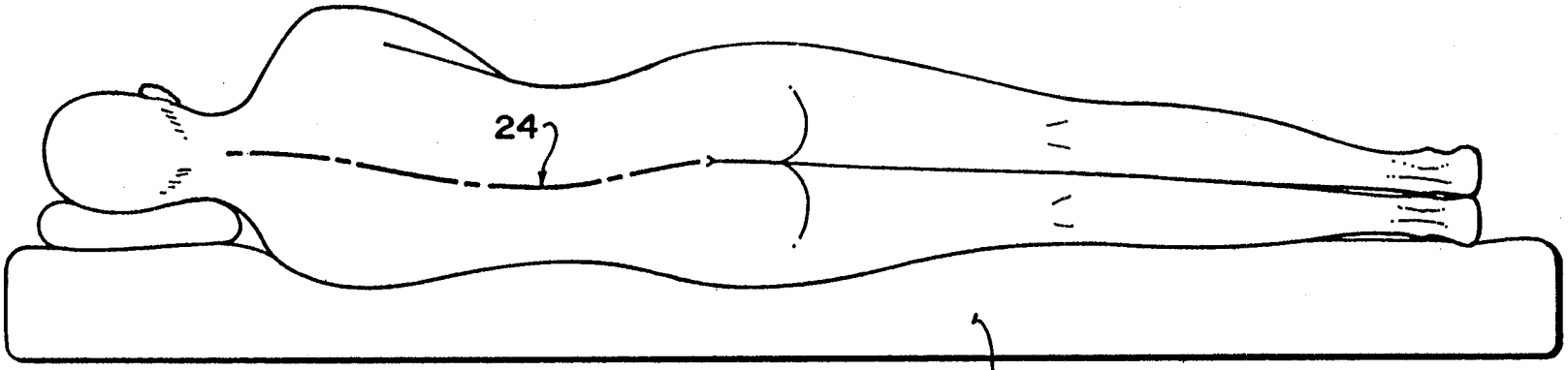
Figure 11:
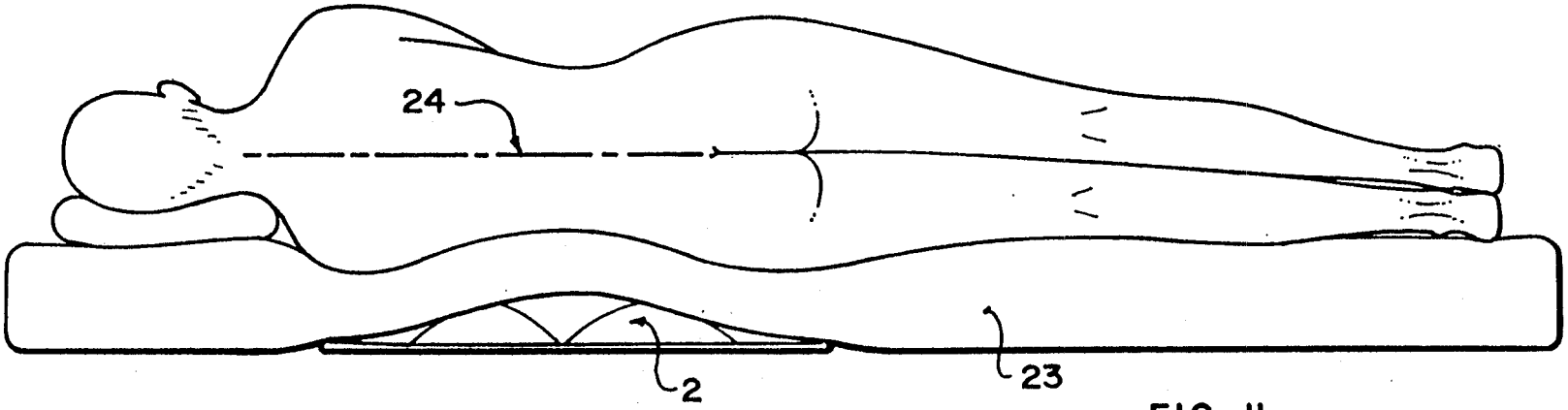
Figure 12:
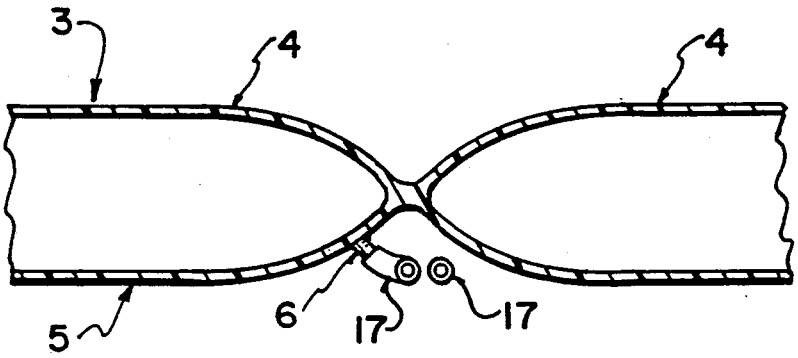
Figure 13:
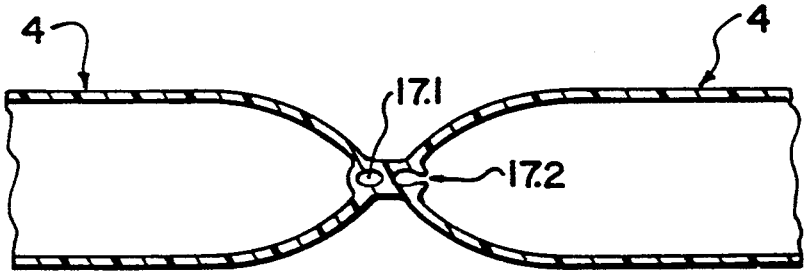

FIGS. 6*a* and 6*b* illustrate respectively a spinal support with individual chambers inflated to various pressures, the support being positioned under a sleep surface to support the spine and body of a left-sided sleeper;

FIGS. 7*a* and 7*b* illustrate respectively a spinal support with individual chambers inflated to various pressures, the support being positioned under a sleep surface to support the spine and body of a right-sided sleeper;

FIGS. 8*a* and 8*b* illustrate respectively a spinal support with individual chambers inflated to various pressures, the support being positioned under a sleep surface to support the spine and body of a sleeper sleeping on his or her back;

FIGS. 9*a* and 9*b* illustrate respectively a spinal support with individual chambers inflated to various pressures, the support being positioned under a sleep surface to support the spine and body of a sleeper sleeping on his or her front side;

FIG. 10 illustrates a side view of a person sleeping on a sleep surface without the benefit of an underlying spinal support;

FIG. 11 illustrates a side view of a person sleeping on a sleep surface with the benefit of an underlying spinal support;

FIG. 12 illustrates a section side view of two support chambers with a valve and tube attached to one chamber; and FIG. 13 illustrates a section side view of two support chambers with the inflation passage constructed in the seam between the chambers.

DETAILED DESCRIPTION OF SPECIFIC EMBODIMENTS OF THE INVENTION

This invention is directed to a unique portable multiple chambered pneumatic inflatable spinal support which can be placed on or under a sleep surface such as a mattress or between a mattress and boxspring. The spinal support is adapted so that specific fine support adjustments can be made to specified areas of the sleep support corresponding to the spinal column and body shape and weight of an individual user. Adjustments in pressure can be made to each inflatable chamber of the spinal support so that the overlying sleep surface is tailored as required to accommodate right or left side sleepers, back or stomach sleepers, or users and sleepers with specific ailments such as lower spine problems. The spinal support enables specific sleep surface areas to be reinforced or elevated for extra height or rigidity in those cases where a sleeper, for medical reasons or otherwise, requires extra support in specific areas. A secondary use of the spinal support is that it can be used to extend the functional life of a mattress by permitting supporting adjustments to be made to the areas of breakdown (sag) which all conventional mattresses inevitably experience.

Figure 1:
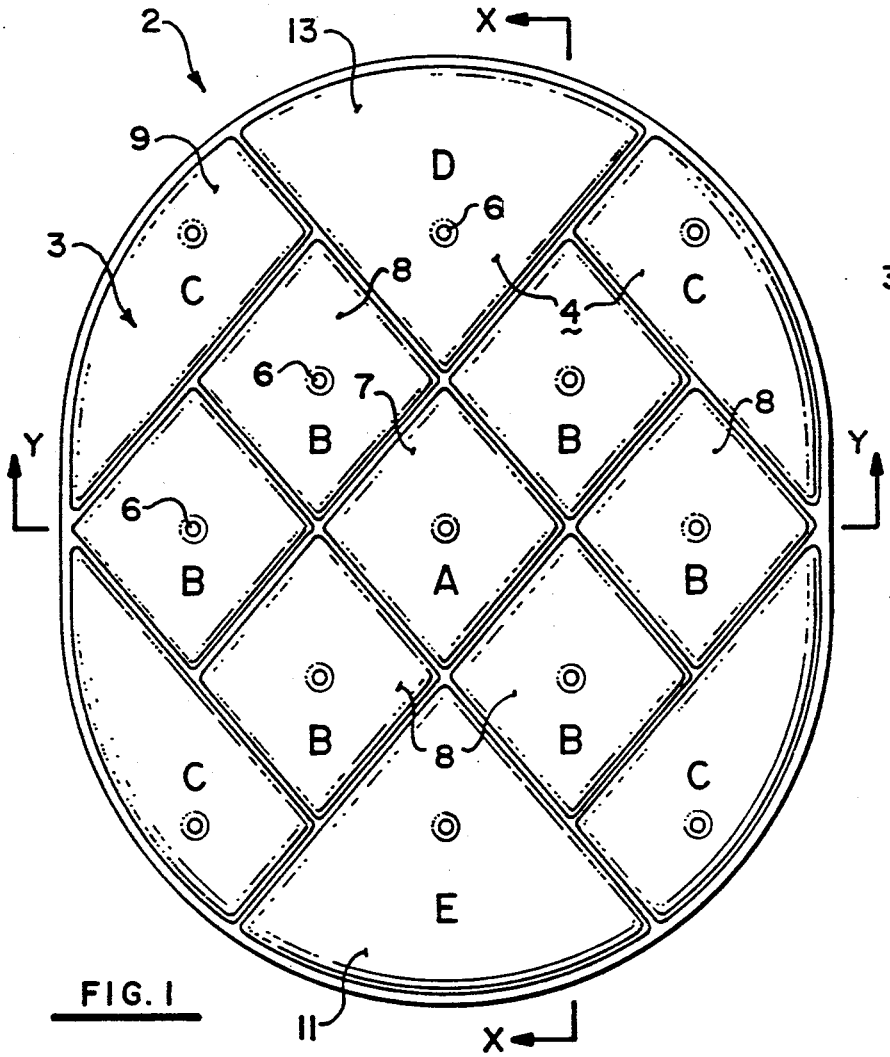
Figure 3A:
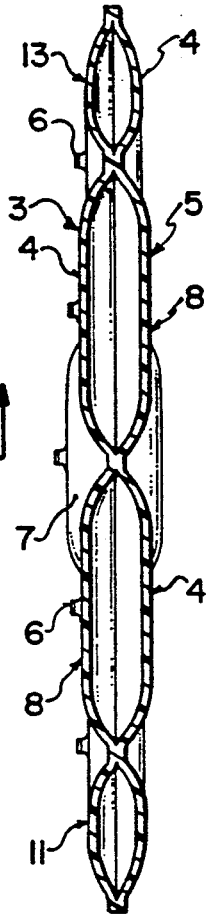
Figure 3B:
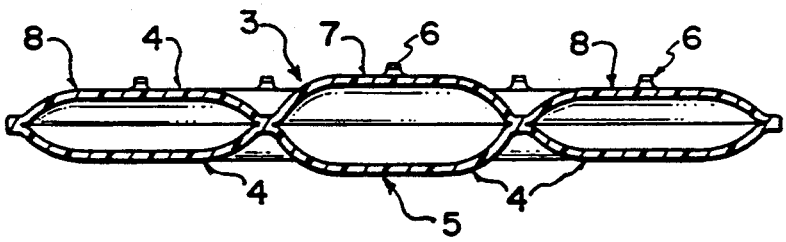
Figure 2:
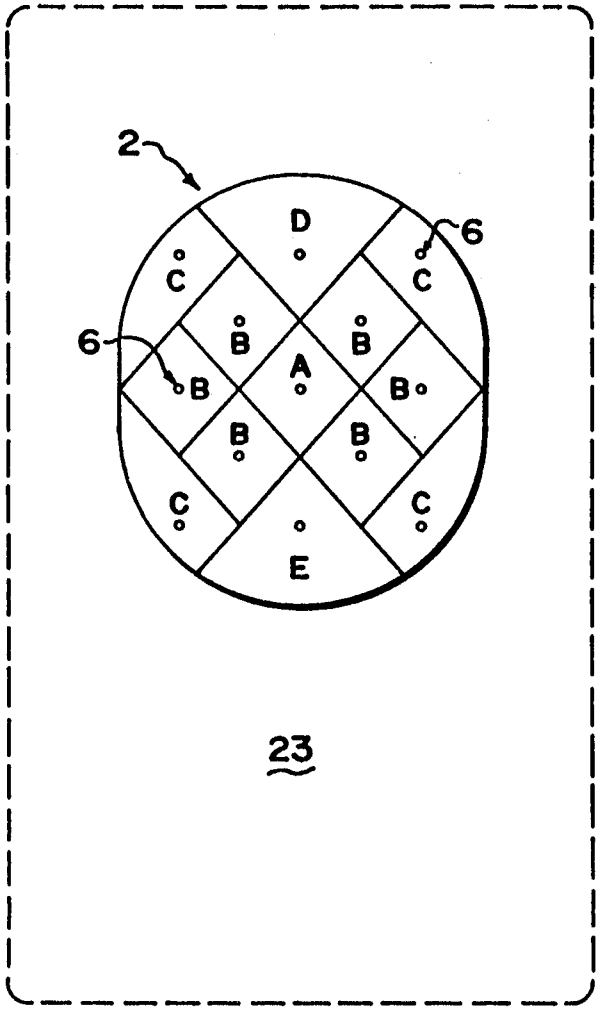

Referring now to FIG. 1, a plan view of the multiple chambered pneumatic inflatable spinal support 2 is illustrated. FIG. 2 is a bottom view of the spinal support 2 positioned under the central area of a sleep surface 23. As can be seen in X—X section view in FIG. 3*a*, and Y—Y section view in FIG. 3*b*, the support 2 is constructed of an upper layer 3, and a lower layer 5, to form a series of adjacent diamond shaped, or triangular shaped inflatable chambers 4, each of which is individually inflatable through individual valves 6. Each chamber 4 can be custom inflated orally or mechanically to any degree, by any person, such as the person using the support 2, or an attendant or nurse in an institution. The chambers 4 can be inflated using a hand pump or some other suitable inflation means. Each specific chamber has been respectively identified by the letter A, B, C, D or E and these are inflated to individual degrees as discussed in detail below. The different types of chambers A, B, C, D or E are respectively identified by chamber type designations 7, 8, 9, 11 and 13 respectively in FIG. 1.

Figure 4:
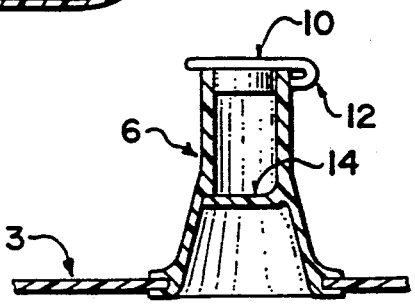
FIG. 4 illustrates a side section view of an air valve that is affixed to each chamber of the spinal support.

Referring to FIG. 4, which illustrates a side section view of the valve 6, the valve 6 is typically constructed to have a valve cap 10, which pivots about valve cap hinge 12. The valve cap 10 is lifted up when a person wants to blow air orally or mechanically into the chamber 4 through the valve 6. Once the desired quantity of air has been blown into the specific chamber 4 to which the valve 6 connects, then cap 10 is pivoted back into position to close the valve 6. An internal one-way flapper 14 is constructed in the interior of the valve 6 and permits air to be blown readily into the chamber 4, but restricts the passage of air out of the interior of the chamber 4. The valve 6 may be pressed into the interior of chamber 4 so that it is flush with the surface.

Figure 5:
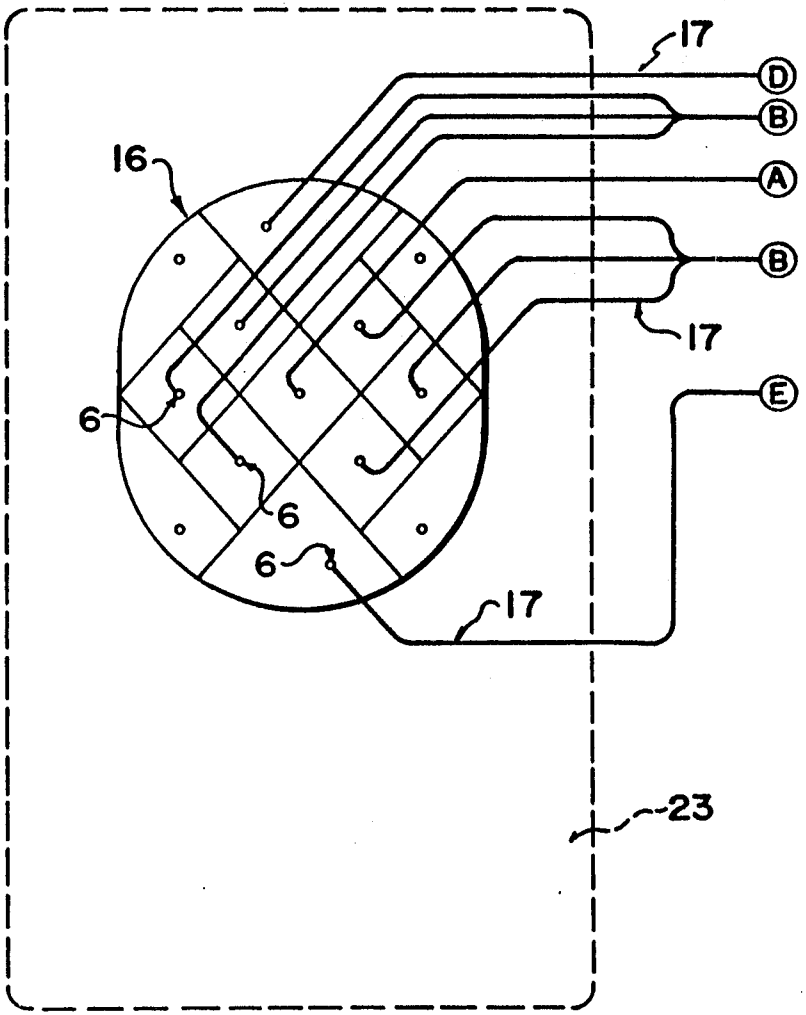
FIG. 5 illustrates a bottom view of a spinal support with individual air tubes connected to the valves of each chamber, underlying a mattress.

FIG. 5 illustrates a bottom view of an alternative design of multiple chamber pneumatic inflatable support 16, positioned under a mattress 23. FIG. 5 illustrates a series of tubes 17 which are connected to each of the valves 6 of the support 16. These tubes 17 enable individual compartments of the support 16 to be custom and remotely inflated to specific desired levels without having to lift the mattress overlying the support 16 or withdrawing the support 16 in order to inflate it.

FIG. 5 also illustrates how the tubes 17 that are connected from a common air source to B Type Chambers on one side of the support 16. In this way, the B Type Chambers can be inflated to a common pressure. Likewise, tubes 17, as a group linked to a common air source, are connected to B Type Chambers on the opposite side of the support 16. In FIG. 5, chambers A, D and E are inflated individually.

FIGS. 6*a* and 6*b* illustrate respectively top view of a spinal support with compartments A, B, C, D and E inflated to various pressures (the numbers shown in FIG. 6A represent inflation percentage for each chamber) and the support positioned under the central area of a sleep surface to support the spine and body of a left-sided sleeper. FIGS. 7*a* and 7*b* illustrate respectively top views of a spinal support with compartments inflated to various pressures and the support positioned under a sleep surface to support the spine and body of a right-sided sleeper. FIGS. 8*a* and 8*b* illustrate respectively a top view of a spinal support with compartments inflated to various pressures and the support positioned under a sleep surface to support the spine and body of a sleeper sleeping on his or her back. FIGS. 9*a* and 9*b* illustrate respectively a spinal support with compartments inflated to various pressures and the support positioned under a sleep surface to support the spine and body of a sleeper sleeping on his or her front side. FIG. 10 illustrates a side view of a person sleeping on a sleep surface 23 without the benefit of an underlying spinal support. It can be readily seen that the spine 24 sags and hence the spine is not in a restful neutral position during sleep. FIG. 11 illustrates a side view of a person sleeping on a sleep surface 23 with the benefit of the underlying spinal support 2. The spine is in a straight horizontal neutral restful position.

More specifically, FIGS. 10 and 11 illustrate side views of the back of a sleeper both with and without the spinal support and demonstrate how spinal deflection is corrected by the spinal support in FIG. 11. In FIG. 10, the unsupported lumbar region of the spine of the sleeper sags downwardly, thereby placing gravitation stress on the spine. In FIG. 11, the lumbar region of the spine is supported and remains in a level neutral position. FIGS. 10 and 11 also show normal shoulder and hip pressure points on any normal sleep surface and how primary chambers A and B in the spinal support cause a counteracting controllable upward force in the waist and mid-torso area of the sleeper to support and rejunvenate the lumbar area of the spine during sleep.

FIG. 12 illustrates a section side view of two inflation chambers 3, with top walls 4 and bottom walls 5. The valve 6 is connected to an inflation tube 17. The position of the valve 6 and tube 17 in the cavity between the two inflated chambers enables the inflation network to be recessed and not create "lumps" in the chambers. The tubes are also not interfered with and hence proper chamber inflation temperatures can be obtained.

FIG. 13 illustrates a section side view of an alternative chamber inflation system where the tube 17.1 is embedded in the seam between the two inflation chambers 4. The tube 17.1 connects with the chamber 4 at location 17.2. The advantage of this system is that the tubes 17.1 are not visible and a "cleaner" support appearance is achieved.

The size of the spinal support is variable and can conform with the size of the overlying mattress and specific support chamber design. Generally, a suitable support size for most applications involving the central area of a single mattress is approximately 36" by 30". This size provides support for the mid-region of the mattress where breakdown most commonly occurs, or support for the lower back of the user if that is required. For double mattresses, larger sizes or two supports can be used. The spinal support is small and is not intended to be used as a mattress per se. Any significant increase in the size of the spinal support would be redundant because primary and secondary adjustment are required only for the spine of the sleeper and the central area of the mattress. Larger devices with more chambers could be built but the increased area would be superfluous because it would not support anything of significance. By means of variable levels of inflation of individual chambers, the support can be used to re-level and vary the firmness of specific areas of any mattress of any size, shape, density, and compression wear.

The spinal support can be constructed of any non-flammable, non-porous airtight material such as flexible polyvinylchloride, polyethylene, rubber or airtight treated fabric. The valves for each chamber should be airtight and preferably collapsible, with an inside flapper valve. The valves should be designed to facilitate mechanical or oral inflation of each individual chamber or airtight cell. The valves can typically be constructed of resilient plastic, such as polyethylene, and can be pushed into the body of the support so that no uncomfortable projections remain. The support is constructed of two layers of any of the above types of air impermeable materials fused by heat or adhesive, around the perimeter, and also along the chamber intersection lines portrayed in FIGS. 1 or 5. Other patterns, to form individual separately inflatable airtight chambers or cells may be feasible. If need be, the support can be constructed to have two or more layers on either side of the central air chambers, for added strength.

The spinal support is constructed so that each chamber is inflated individually. Preferably each chamber is independent. There is no interconnection between neighbouring chambers unless it is advantageous in specific instances to have such connection(s). In certain applications, for example, it may be advantageous to have interconnections between groups of chambers, or a commonly linked set of inflation tubes (see FIG. 5), to provide desired inflation patterns. Thus, if the support is to be customized for a left-sided sleeper (see FIGS. 6*a* and 6*b*), it may be advantageous to inflate to the same specified pressure all common chambers that support the hips, trunk and shoulders of a left-sided sleeper (see inflation pattern illustrated in FIG. 6*a*). In FIG. 5, all B Type Chambers on one side are commonly inflated through interlinked tubes to a unitary pressure, and all B Type Chambers on the other side are commonly inflated through interlinked tubes to a second specific unitary pressure.

Each chamber, or group of chambers, in the spinal support is specifically designed for low-pressure custom inflation and deflation by oral or mechanical means prior to being placed above or underneath the mattress, or between the mattress and underlying boxspring. When the correct inflation pattern is used (see FIG. 6*a*, for example), the support is custom adjusted to individual requirements, and will support all normal variations of the human body during sleep. Thus level spinal alignment from shoulder to hips is maintained as illustrated in FIG. 11.

It is fact that a sag occurs in all mattresses, new or used. When this sag is severe, a hard surface (plywood board) can be placed under the support to increase the desired overall support. A certain amount of experimentation by the user, or the patient's aide, will be required when the support is first used. Once the desired degree of inflation for each chamber is determined, the spinal support provides support for the prone human body customized according to the person who sleeps on his or her stomach, back, or in the recommended back pain reducing side fetal position. FIGS. 7*a* through 9*a* illustrate typical spinal support chamber pressures for right-sided, back and front sleepers.

Specific Functions and Inflation Patterns of Chambers

FIG. 1 shows specific support cell types, identified with the letters A, B, C, D and E. The function of each type of chamber is listed below alphabetically. Inflation for each chamber is adjustable over the range 0 to 100 percent, but normally inbetween pressures in the range of 5 to 40 percent are used.

An A Type Chamber (usually one) is centrally located in the spinal support and is intended primarily for spinal midrift sag correction or specific patient support for that area. Generally, the inflation level for a type A chamber is relatively high, that is, approximately 40 percent, for left and right-sided sleepers, as shown in FIGS. 6*a* and 7*a*.

B Type Chambers (usually six) are located on the left and right sides of the A Type Chamber and are intended for secondary spinal midrift sag correction or support. These B Type Chambers are typically grouped in three chambers on both the left and right side of the support surrounding the primary A type chambers. When the person primarily sleeps on the left or right side, the B type chambers on the side opposite to the side on which the subject sleeps are inflated to a lower level because those chambers are only required to support the sleeper's arms and legs, which have less weight. (See the difference in left and right side B Type Chamber inflation pressures in FIGS. 6*a* and 7*a*.) The B Type Chambers can typically be inflated to about 20 to 30 percent on the load bearing side (see FIGS. 6*a*, 7*a*, 8*a* and 9*a*).

C Type Chambers (usually four) are located at the peripheral areas of the spinal support and are intended as peripheral levelling chambers to even out or level the sleep wear areas of the mattress with the unused areas of the mattress. The C Type Chambers also have a cradling effect on the sleeper, inducing the sleeper to remain in the desired therapeutic sleep pattern over the support. The inflation level for a C Type Chamber is typically about 10 percent.

A D Type Chamber (usually one) is positioned under the shoulder area of the sleeper. The D Type Chamber can be inflated to a higher pressure when a user sleeps on his or her stomach or back. The D Type Chamber usually has an inflation level of approximately 20 percent when the person sleeps on his or her stomach or back. However, when the user sleeps in the left or right side fetal position, the lower shoulder in each case projects downwardly and becomes a primary pressure point. In such a case, the D Type Chamber typically requires little or no inflation, e.g. 0 to 5 percent.

An E Type Chamber (usually one) is positioned under the hips of the user. When the user sleeps on his or her stomach, this chamber usually requires approximately 10 to 15 percent inflation level. When the person habitually sleeps on his or her back, inflation is usually reduced to 10 percent or less to accommodate the downward projection of the buttocks.

When the user sleeps on his or her side, the hip area, corresponding to the location of an E type chamber, becomes a primary downward pressure point, proportional to hip size and weight, and will usually require a lesser inflation level ranging from 0 to 5 percent.

The above mentioned inflation levels for the various type chambers are only guidelines that are typical of a mattress that is in reasonably good condition. Inflation levels of different types of chambers can be varied to accommodate specific situations. In extreme conditions, where aggressive spinal support is required, or there is excessive breakdown of areas of the mattress, it may be necessary to fully inflate certain chambers to provide spinal support or compensate for the broken down areas. In determining the proper inflation level for each chamber, the user can individually and progressively inflate each chamber a certain amount and by trial and error reach required inflation levels and patterns for the specific situation. Alternatively, it may be more convenient and represent a useful technique to inflate each chamber 100 percent and then adjust for the localized spine or sag areas by deflating each chamber a certain amount using a trial and error method until the desired results are achieved.

By means of a customized pattern of individual chambers inflated to varying degrees, spinal support is transferred upwardly through the mattress to thereby maintain the spine of the person or patient in a relatively linear horizontal orientation during sleep (see FIG. 11). The spine historically has evolved as a suspension (tension) system used in association with four legged animals. When man started walking erectly, the spine was placed under compression which is basically unnatural and deleterious to the long term health of the spine. It is therefore generally recognized that keeping th spine horizontal and extended, rather than compressed, during sleep allows the spine to "rest", that is, there is a minimum of compression or tension force applied to the spine during the typical seven to eight hour sleeping time. The spine can then rejuvenate for the next day's activities. The support and individual chambers react to overall body weight, and provide displacement of that weight throughout the body.

The spinal support may also be used for those victims with congenital or injured spinal conditions. The spinal support has special application for the medical profession by increasing the sleeping comfort for patients with lower back (lumbar) problems, or if they are recovering from surgery and wish to have support in specific areas and to deflect weight from the affected area. In this special application, the support may be used on top of the sleep surface for easier insertion and adjustment under the patient by an attendant. However, the support can always be used in association with a mattress. In such applications, the chamber valves may be inflated by tubes which extend to the side of the bed (see FIG. 5). This enables custom chamber inflation by means of a manual hand pump connected in turn to each tube by the attendant. The patient can already be in the prone position on top of the spinal support.

EXAMPLE

Five prototypes with a configuration according to FIG. 1 have been tested on a confidential basis for about the past four years by five different users. The five users, prior to the commencement of the test, were all affected with lower back (lumbar) spinal pain problems. One user is tall, which usually leads to back pain at some time. Another user had worked on an oil rig at one time and had injured his back. The others had lower back pain problems precipitated for one reason or another. After only a short period of use of the prototypes, under the mattresses of the respective users, custom inflated to each user's requirements, all five users experienced either considerable reduction or complete elimination of back pain. This improved condition has continued.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. A method of providing specific support to specific trunk and torso regions of a person's spine while the person is reclining, comprising placing under the trunk and torso of the person:

(a) a first type discrete pneumatically inflatable chamber;

(b) at least two second type discrete pneumatically inflatable chambers located on one side and adjacent to the first type chamber;

(c) at least two third type discrete pneumatically inflatable chambers located adjacent to the first type chamber on the side opposite to the second type chambers;

(d) at least two fourth type discrete pneumatically inflatable chambers, one located adjacent to and at one end of the first chamber and the other located adjacent to the first chamber at the opposite end; and (e) inflating the first type chamber (a) to about 30 to 40 percent, inflating the second type chamber (b) about 20 to 30 percent, inflating the third type chamber (c) about 20 to 30 percent, and inflating the fourth type chamber (d) about 5 to 10 percent.

2. A method as claimed in claim 1 wherein the specific support is provided under the mid-region of a mattress, upon which the person is reclining.

3. A method as claimed in claim 1 wherein the two second type chambers (b) are connected to a common air pressure source and are inflated at the same time from the common air pressure source.

4. A method as claimed in claim 3 wherein the two third type chambers (c) are connected to a common air pressure source and are inflated at the same time from the second common air pressure source.

5. A method as claimed in claim 1 wherein the chambers are inflated through conduits which are located in seams between each chamber.

6. A portable multiple chambered pneumatically inflatable spinal support comprising:

(a) a first type discrete pneumatically inflatable chamber located in the interior of the support;

(b) at least two second type discrete pneumatically inflatable chambers located on one side and ad]acent to the first chamber;

(c) at least two third type discrete pneumatically inflatable chambers located adjacent to the first chamber on the side opposite to the second chambers;

(d) at least two fourth type discrete pneumatically inflatable chambers, one located adjacent to the first chamber at one end of the support and the other located adjacent to the first chamber at the opposite end of the support; and, (e) inflation valve means for each chamber, said inflation valve means being operable for inflation and closable after the respective chamber has been inflated pneumatically.

7. A support as claimed in claim 6 wherein elongated tubes are connected to each of the valve means connected to each individual chamber, each individual chamber being inflatable by the tube that is specifically connected to the specific chamber and its valve means.

8. A support as claimed in claim 7 wherein the tubes connected to second type chambers (b) are connected together so that chambers (b) are inflated commonly at the same time to the same pressure.

9. A support as claimed in claim 8 wherein the tubes connected to the third type chambers (c) ar connected together so that chambers (c) are inflated commonly at the same time to the same pressure.

10. A support as claimed in claim 9 wherein the first chamber (a) is of a diamond shape, and the second and third type chambers (b) and (c) are of a diamond shape and comprise at least six in number, three of which are disposed adjacent one another on one side of the first type chamber (a), and the other three are disposed adjacent one another on the opposite side of the first type chamber (a).

11. A support as claimed in claim 6 wherein the support includes at least two fifth type discrete pneumatically inflatable chambers, each located to the exterior of the first four types of chambers (a), (b), (c) and (d).

12. A support as claimed in claim 11 wherein the fourth type chamber (d) is of a triangular shape, one being wedged between the second type chamber (b), and the other being wedged between the third type chamber (c).

13. A support as claimed in claim 6 wherein one or more of the chambers are connected together and can be inflated as a unit.

14. A support as claimed in claim 7 wherein the valve means and tubes are located in recesses which exist between each adjacent chamber.

15. A support as claimed in claim 6 wherein the valve means are embedded in areas between ad]acent chambers and inflation conduits to each chamber are located in the areas between adjacent chambers.

* * * * *

UNITED STATES PATENT AND TRADEMARK OFFICE

CERTIFICATE OF CORRECTION

PATENT NO. : 5,070,559

DATED : December 10, 1991

INVENTOR(S) : Richard T. Pettifer

It is certified that error appears in the above-identified patent and that said Letters Patent is hereby corrected as shown below:

Column 10, line 18, after "keeping" insert --e-- to the word th

Column 11, claim 6(b), in the word adjacent delete "]" and insert --j--

Column 12, claim 9(c), insert --e-- to the word ar

Column 12, claim 15, line 47 in the word adjacent delete "]" and insert --j--

Signed and Sealed this

Tenth Day of August, 1993

*Attest:*

Michael K. Kirk

MICHAEL K. KIRK

*Attesting Officer*

*Acting Commissioner of Patents and Trademarks*